US009205427B2

(12) United States Patent
Lindberg et al.

(10) Patent No.: US 9,205,427 B2
(45) Date of Patent: Dec. 8, 2015

(54) GYRATORY CRUSHER OUTER CRUSHING SHELL

(71) Applicant: SANDVIK INTELLECTUAL PROPERTY AB, Sandviken (SE)

(72) Inventors: Mikael Lindberg, Svedala (SE); Andreas Christoffersson, Svedala (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

(21) Appl. No.: 14/217,728

(22) Filed: Mar. 18, 2014

(65) Prior Publication Data

US 2014/0284410 A1 Sep. 25, 2014

(30) Foreign Application Priority Data

Mar. 19, 2013 (WO) ..... PCT/EP2013/055704

(51) Int. Cl.

| | |
|---|---|
| ***B02C 2/06*** | (2006.01) |
| ***B02C 2/04*** | (2006.01) |
| ***B02C 2/02*** | (2006.01) |
| ***B02C 2/00*** | (2006.01) |

(52) U.S. Cl.

CPC . *B02C 2/04* (2013.01); *B02C 2/005* (2013.01); *B02C 2/02* (2013.01)

(58) Field of Classification Search

CPC ..... B02C 2/00; B02C 2/02; B02C 2/04; B02C 2/05; B02C 2/06; B02C 2/005

USPC ..... 241/207, 209

See application file for complete search history.

(56) References Cited

U.S. PATENT DOCUMENTS

| | | | | |
|---|---|---|---|---|
| 5,769,340 | A | 6/1998 | Jean | |
| 6,299,083 | B1 * | 10/2001 | Polinski et al. | 241/207 |
| 2004/0159728 | A1 * | 8/2004 | Hamada et al. | 241/209 |
| 2010/0270409 | A1 | 10/2010 | Eriksson et al. | |
| 2015/0060584 | A1 * | 3/2015 | Aberg et al. | 241/209 |

FOREIGN PATENT DOCUMENTS

| | | | |
|---|---|---|---|
| GB | 1328816 | | 9/1973 |
| WO | 03099443 | A1 | 12/2003 |

* cited by examiner

*Primary Examiner* — Faye Francis

(74) *Attorney, Agent, or Firm* — Corinne R. Gorski

(57) ABSTRACT

A gyratory crusher outer crushing shell. The outer crushing shell comprises an upper contact surface region that is divided into a plurality of elongate circumferentially extending shoulders. The shoulders are separated by recessed gap regions adapted to accommodate a suitable backing material to structurally reinforce the shell. A channel extends circumferentially around the shell in the outward facing surface to axially separate the upper contact surface region from a lower contact surface region. The channel is also adapted to accommodate the backing material.

14 Claims, 6 Drawing Sheets

GYRATORY CRUSHER OUTER CRUSHING SHELL

RELATED APPLICATION DATA

This application claims priority under 35 U.S.C. §119 to Patent Application No. PCT/EP2013/055704, filed on Mar. 19, 2013, which the entirety thereof is herein incorporated by reference.

TECHNICAL FIELD

The present disclosure relates to a gyratory crusher outer crushing shell and in particular, although not exclusively, to a shell having axially upper and lower raised contact sections separated by a channel that may be conveniently filled with a backing material to structurally reinforce the shell if required.

BACKGROUND

Gyratory crushers are used for crushing ore, mineral and rock material to smaller sizes. Typically, the crusher comprises a crushing head mounted upon an elongate main shaft. A first crushing shell (typically referred to as a mantle) is mounted on the crushing head and a second crushing shell (typically referred to as a concave) is mounted on a frame such that the first and second crushing shells define together a crushing chamber through which the material to be crushed is passed. A driving device positioned at a lower region of the main shaft is configured to rotate an eccentric assembly positioned about the shaft to cause the crushing head to perform a gyratory pendulum movement and crush the material introduced in the crushing chamber. Example gyratory crushers are described in WO 2004/110626; WO 2008/140375, WO 2010/123431, U.S. 2009/0008489, GB 1570015, U.S. Pat. No. 6,536,693, JP 2004-136252, U.S. Pat. No. 1,791,584 and WO 2012/005651.

Primary crushers are heavy-duty machines designed to process large material sizes of the order of one meter. Secondary and tertiary crushers are however intended to process relatively smaller feed materials typically of a size less than 35 centimeters. Cone crushers represent a sub-category of gyratory crushers and may be utilised as downstream crushers due to their high reduction ratios and low wear rates.

Typically, both the inner and outer crushing shells wear and distort due to the significant pressures and impact loading forces they transmit. In particular, it is common to use backing compounds to structurally reinforce the outer shell and assist with contact between the radially outward facing surface of the outer shell and the radially inward facing surface of the topshell. In particular, a backing compound (typically an epoxy or polyurethane material) is cured around the outer region of the concave to provide structural support to the concave during the crushing operation particularly in tough high-pressures applications involving, for example, processing extremely hard materials. Example backing compounds are available from ITW ('Korroflex') Ltd, Birkshaw UK under brand names Korrobond 65™ and 90™; and Monach Industrial Products (I) Pvt., Ltd, India, under brand name KrushMore™.

However, the majority of widely used backing compounds are disadvantageous for health and environmental reasons and require long curing times that extends the downtime of the crusher. Accordingly, there is a general preference to avoid their use. However, in high pressure and tough applications the use of backing compounds is often unavoidable to add structural support and this is typically difficult to predict beforehand. There is therefore a need for an outer crushing shell that may be conveniently reinforced to suit a particular use by an end user.

SUMMARY

It is an object of the present disclosure to provide an outer crushing shell (concave) that is optimised to allow a user to modify the physical dimensions and shape configuration of discreet regions of the shell to redress any wear and distortion of the shell and to help ensure the shell is seated correctly within the topshell frame part. Specifically, the present crushing shell is intended for possible use in combination with a backing material to structurally reinforce the shell by increasing the combined shell wall thickness (shell plus backing material) at discreet regions or channels. It is a further object to facilitate the physical modification of the shell by an end user in situ at the crusher (if desired) to suit a user's specific crushing operation.

The objects are achieved, in part, by providing a crushing shell having a raised contact region that is divided into one or more sections extending circumferentially around the main longitudinal axis of the shell via one or a plurality of grooves. In particular, the grooves provide pathways through the upper raised contact region to an axially underlying channel into which the backing material may flow and fill so as to reinforce the shell for tough operating conditions for example. Additionally, the grooves themselves may be filled with backing material. Preferably, the shell comprises a plurality of raised sections defined by and extending between a plurality of grooves recessed in the radially outward facing surface (mount surface) of the shell.

The present crushing shell is configured to be conveniently reinforced by accommodating backing material within the annular channel recessed into the radially outward facing surface of the shell at a position between an axially upper contact surface and an axially lower contact surface. The circumferentially spaced and recessed pathways extend from and communicate with the annular channel such that backing material may be introduced from the region of the uppermost end of the shell and cured conveniently within the channel via a single procedure with the shell positioned in situ within the crusher. The present crushing shell is compatible for use with all types of backing material typically used in the mineral processing fields for reinforcement of crushing components including by way of example epoxy and polyurethane materials and in particular materials available from ITW ('Korroflex') Ltd, Birkshaw UK under brand names Korrobond 65™ and 90™; and Monach Industrial Products (I) Pvt., Ltd, India, under brand name KrushMore™. Additionally, further suitable backing compounds include more environmentally friendly and less health hazardous formulations.

Additionally, the present crushing shell is configured for and compatible with all types of gyratory crusher including primary, secondary and tertiary crushers encompassing cone crushers. The present crushing shell is particularly suitable for high pressure and high power input crushing applications where there exists a risk of excessive and/or accelerated wear of the crushing shell and topshell contact surfaces. The present crushing shell is configured to be back-filled conveniently and may also restore the desired clearance and fit between the outer crushing shell and topshell frame. Accordingly, the dimensions of the present shell may be maintained conveniently which in turn is advantageous to avoid the significant cost and time of repairing a damaged topshell frame part that would result from operation with a damaged and/or worn crushing shell.

According to a first aspect of the present disclosure there is provided a gyratory crusher outer crushing shell including: a main body mountable within a region of a topshell frame of a gyratory crusher, the main body extending around a central longitudinal axis; the main body having a mount surface being outward facing relative to the axis for positioning opposed to at least a part of the topshell frame and a crushing surface being inward facing relative to the axis to contact material to be crushed, at least one wall defined by and extending radially between the mount surface and the crushing surface, the wall having a first upper axial end and a second lower axial end; a raised first contact region positioned axially towards the first upper axial end and extending radially outward relative to the mount surface and in a direction around the axis, the contact region having a radially outward facing raised first contact surface for positioning opposed to a radially inward facing surface of the topshell frame; a raised second contact region positioned axially towards the second lower axial end and extending radially outward relative to the mount surface in a direction around the axis, the second contact region having a radially outward facing raised second contact surface for positioning opposed to a radially inward facing surface of the topshell frame, the second contact surface extending continuously over the mount surface and around the axis; and a channel extending around the axis and recessed radially inward relative to the first and second contact regions to axially separate the first and second contact regions. The first contact surface is discontinuous in a direction around the axis via at least one groove extending radially inward within the contact region to provide a pathway through the raised first contact region in the axial direction between a region of mount surface at the first upper axial end and the channel.

The second contact surface extends continuously over the mount surface and around the axis and is devoid of the grooves formed in the upper contact region. This configuration provides an uninterrupted and continuous annular ridge to prevent the onward and downward flow of backing material when introduced onto the shell from above such that the channel may be filled completely.

Preferably, the region of mount surface at the first upper axial end is positioned axially between the first upper axial end and the raised first contact region.

In particular the at least one groove may extend radially by a distance corresponding substantially to at least a full depth of the raised first contact region and in a direction axially upward within the first contact region from the axially lower channel.

Preferably, the first and second contact surfaces comprise a metal. Typically, the main body of the shell comprises manganese steel and the first and second contact surfaces comprise manganese steel or other alloy such that the main body and contact surface are the same material.

Optionally, the first and second contact surfaces are coplanar around the axis. Optionally, the first and second contact surfaces are aligned transverse to one another relative to the central axis. In particular, the first and upper contact surface is aligned substantially vertically in normal use that corresponds substantially to a parallel alignment with the central main axis extending through the crusher. In contrast, the second and lower contact surface is orientated to be inclined relative to the central axis such that an upper edge of the lower contact surface is positioned radially closer to the axis whilst a lower edge is positioned further from the axis (relative to the upper edge). Accordingly, a general shape of the shell is a frusto-conical annulus having an inner diameter that increases substantially continuously from the first upper end to the second lower end.

Optionally, a radial depth of the at least one groove is substantially equal to a radial depth of the first contact region defined by a radial distance between the first contact surface and the mount surface. Optionally, a radial depth of the at least one groove is greater than a radial thickness of the first contact region defined by a radial distance between the first contact surface and the mount surface. Alternatively, a radial depth of the at least one groove is less than a radial thickness of the first contact region defined by a radial distance between the first contact surface and the mount surface. That is, the groove depth may be equal to, more or less than a radial thickness of the raised contact region(s). Optionally, the shell comprises six grooves defining six contact shoulder sections arranged around the axis. However, the present shell may comprise any number of contact shoulder regions distributed circumferentially around the outward facing surface of the shell. In particular, the shell may comprise between one to twenty contact shoulder sections separated respectively by one to twenty grooves.

Optionally, the contact shoulder sections extend around the axis over an arcuate distance in a range 45° to 55° relative to the central axis. Optionally, each groove extends around the axis and between the contact shoulder sections over an arcuate distance in a range 5 to 15° relative to the central axis.

Optionally, the present shell may comprise a backing material accommodated at least partially within the channel and optionally with grooves.

Reference within the specification to 'the first and/or second contact surface configured to contact or for positioning opposed to a radially inward facing surface of the topshell frame', includes direct and indirect contact with the topshell. In particular, the first upper and second contact surface of the present crushing shell, in certain embodiments, may be configured for positioning in direct contact with the inward facing surface of the topshell.

However, in certain other embodiments a spacer, (alternatively termed a filler) ring may be positioned radially intermediate between the axially upper first contact surface of the outer crushing shell and the radially inner facing surface of the topshell so as to be at least partially sandwiched between the concave and the topshell.

According to one embodiment, the present crushing shell comprises a first upper contact surface that is aligned substantially parallel to the central main axis. This particular embodiment is suitable for use in conjunction with a spacer ring that sits intermediate between this upper contact surface of the concave and the topshell frame. This embodiment is also suitable for direct contact with the topshell without the need for an intermediate spacer ring.

Optionally, the shell comprises: a third contact region extending radially outward relative to the mount surface in a direction around the axis, the third contact region having a radially outward facing contact surface for positioning opposed to a radially inward facing surface of the topshell frame; and a channel extending around the axis and recessed radially inward relative to the raised third contact region and the raised second contact region to axially separate the second and third contact regions. The radial depth of the groove extending axially through this third region may be equal to, more or less than a radial thickness of the third raised region.

Where the shell comprises three raised contact regions and surfaces, the shell may be configured for positioning indirectly at the topshell via a spacer ring that is designed to be positioned radially intermediate the entire axial length of the shell including all three raised contact regions such that no part of the shell sits in direct contact with the radially inner facing surface of the topshell.

Additionally, reference within the specification to 'grooves' encompasses alternative terms such as 'recessed gap regions', 'gaps', 'recesses', 'pockets', 'depressions' or 'indentations' that extend radially into the raised first (and optionally third) contact region and provide a flow path allowing for the introduction of backing material into the axially lower channel(s).

According to a second aspect of the present disclosure there is provided a crusher comprising an outer crushing shell as described herein.

BRIEF DESCRIPTION OF DRAWINGS

A specific implementation of the present disclosure will now be described, by way of example only, and with reference to the accompanying drawings in which.

DETAILED DESCRIPTION

Figure 1:
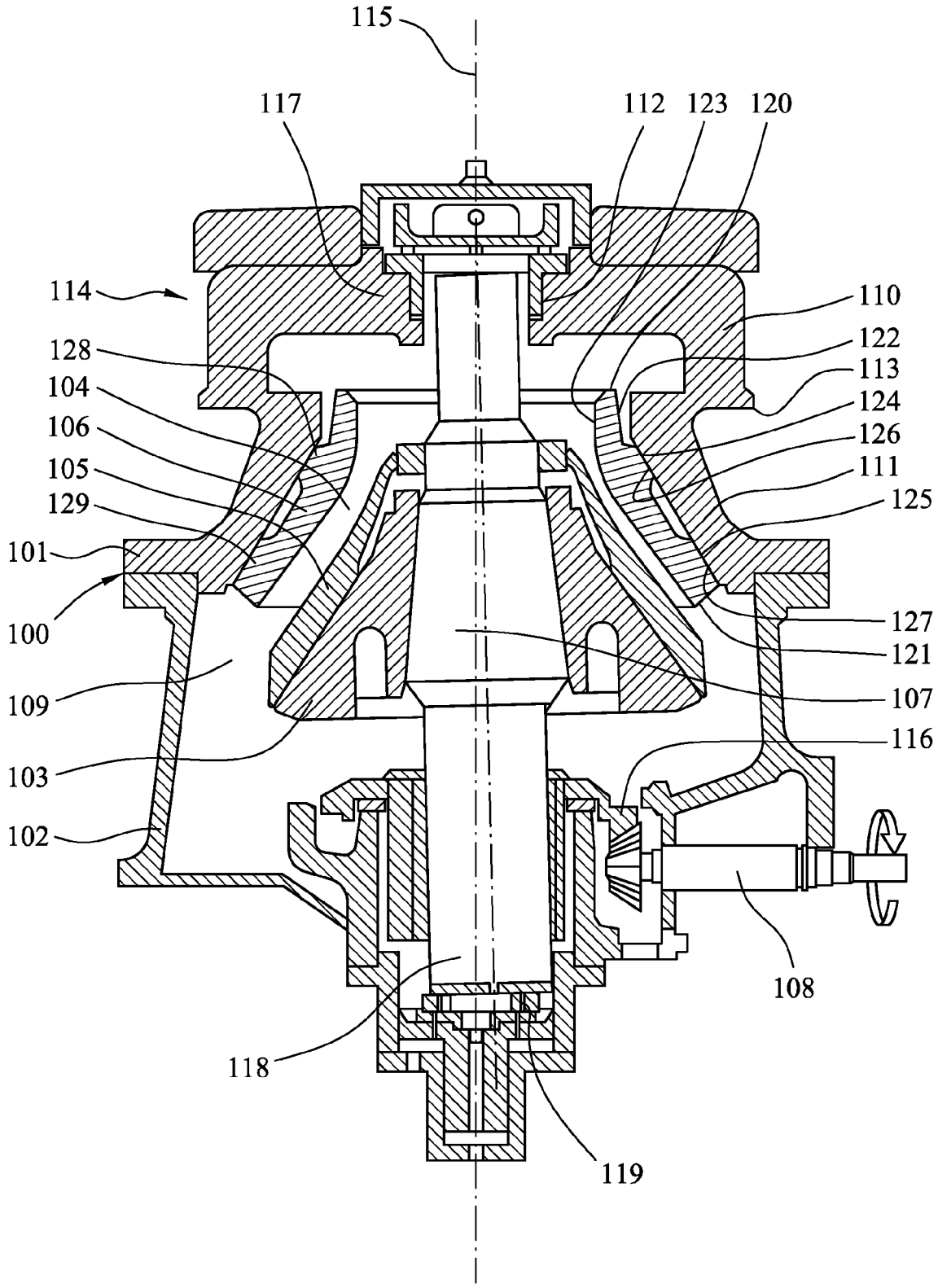
FIG. 1 is a cross sectional elevation view of a gyratory crusher comprising an outer crushing shell (concave) and an inner crusher shell (mantle) according to a specific implementation of the present invention.
Figure 2:
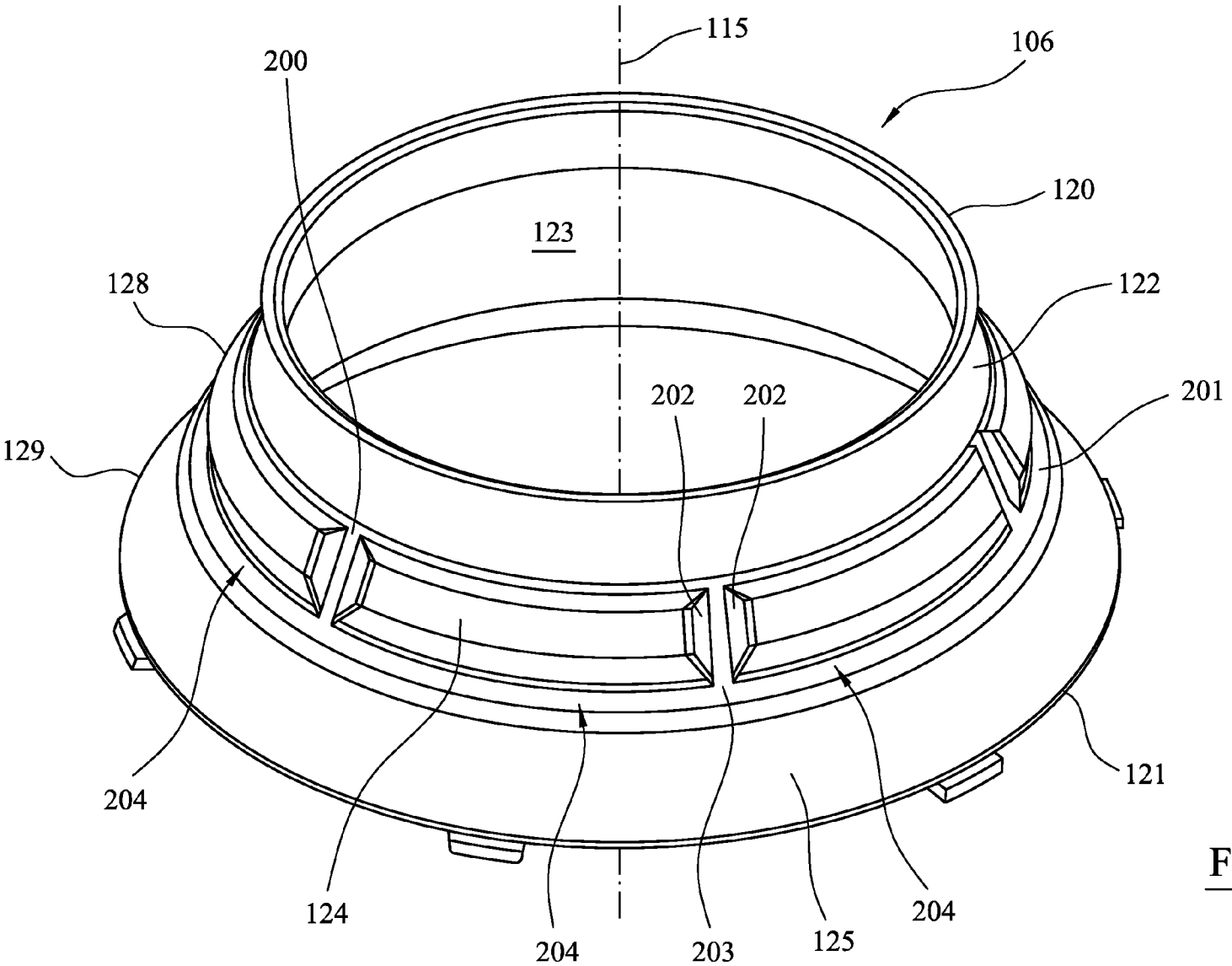
FIG. 2 is a perspective view of the outer crushing shell illustrated in FIG. 1.
Figure 3:
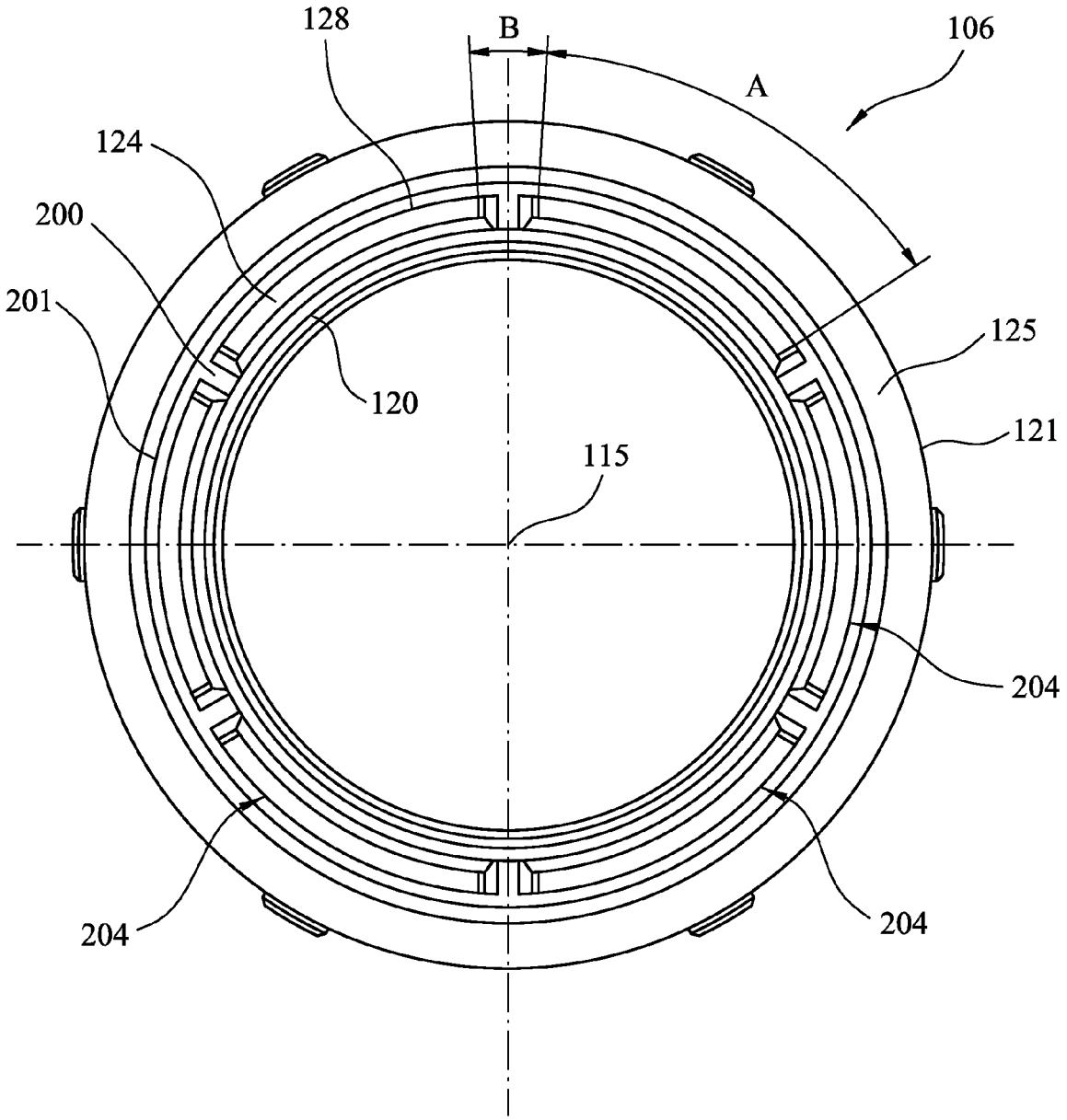
FIG. 3 is a plan view of the crushing shell of FIG. 2.

Referring to FIG. 1, a crusher comprises a frame 100 having an upper frame 101 and a lower frame 102. A crushing head 103 is mounted upon an elongate shaft 107. A first (inner) crushing shell 105 is fixably mounted on crushing head 103 and a second (outer) crushing shell 106 is fixably mounted at upper frame 101. A crushing zone 104 is formed between the opposed crushing shells 105, 106. A discharge zone 109 is positioned immediately below crushing zone 104 and is defined, in part, by lower frame 102.

A drive (not shown) is coupled to main shaft 107 via a drive shaft 108 and suitable gearing 116 so as to rotate shaft 107 eccentrically about longitudinal axis 115 and to cause head 103 and mantle 105 to perform a gyratory pendulum movement and crush material introduced into crushing chamber 104. An upper end region of shaft 107 is maintained in an axially rotatable position by a top-end bearing assembly 112 positioned intermediate between main shaft 107 and a central boss 117 positioned on axis 115 that extends through frame 100 and the gyratory crusher generally. Similarly, a bottom end 118 of shaft 107 is supported by a bottom-end bearing assembly 119.

Upper frame 101 is divided into a topshell 111, mounted upon lower frame 102 (alternatively termed a bottom shell), and a spider assembly 114 that extends from topshell 111 and represents an upper portion of the crusher. The spider 114 comprises two diametrically opposed arms 110 that extend radially outward from central boss 117. Arms 110 are attached to an upper region of topshell 111 via an intermediate annular flange (or rim) 113 that is centred on axis 115. Typically, arms 110 and topshell 111 form a unitary structure and are formed integrally.

Outer shell 106 is positioned within crusher frame 101 in contact with a radially inward facing surface of the topshell 111. In particular, shell 106 comprises a first upper axial end 120 and a second lower axial end 121. When housed within the crusher, end 120 is approximately aligned axially with rim 113 and second end 121 is aligned axially at the junction between topshell 111 and bottom shell 102.

Shell 106 includes a radially inward facing crushing surface 123 that extends axially between first 120 and second 121 ends. Crushing face 123 is intended for contact with the material to be crushed that passes between the opposed crushing shells 105, 106 and within crushing chamber 104. Shell 106 further has a radially outward facing mount surface 122 such that a shell wall is defined between the crushing 123 and mount 122 surfaces.

Shell 106 is mated against a radially inward facing surface of topshell 111 via two annular contact regions 128, 129. Each region 128, 129 extends radially outward relative to mount surface 122 that corresponds to a region immediately below upper end 120 such that each region 128, 129 represents a respective region of shell 106 having the greatest radial thickness relative to none 'raised' regions. First contact region 128 is positioned in an upper axial half of shell 106 and second contact region 129 is positioned in an axially lower half of shell 106. Each contact region 128, 129 has a respective contact surface 124, 125. The surfaces 124, 125 are configured for abutment against respective regions 126, 127 of the radially inward facing surface of topshell 111.

Figure 4:
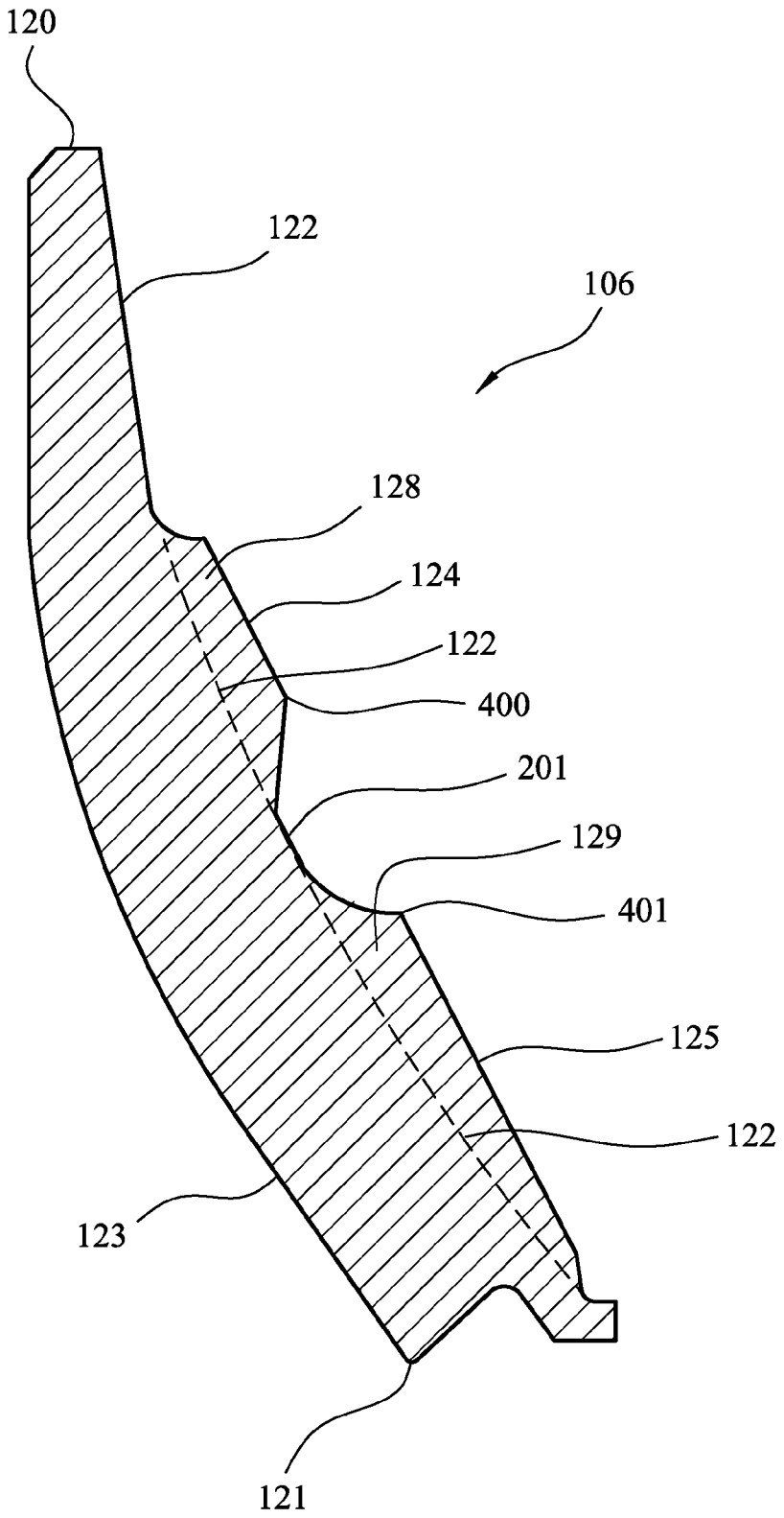
FIG. 4 is a cross sectional elevation view through the crushing shell of FIG. 3.
Figure 5:
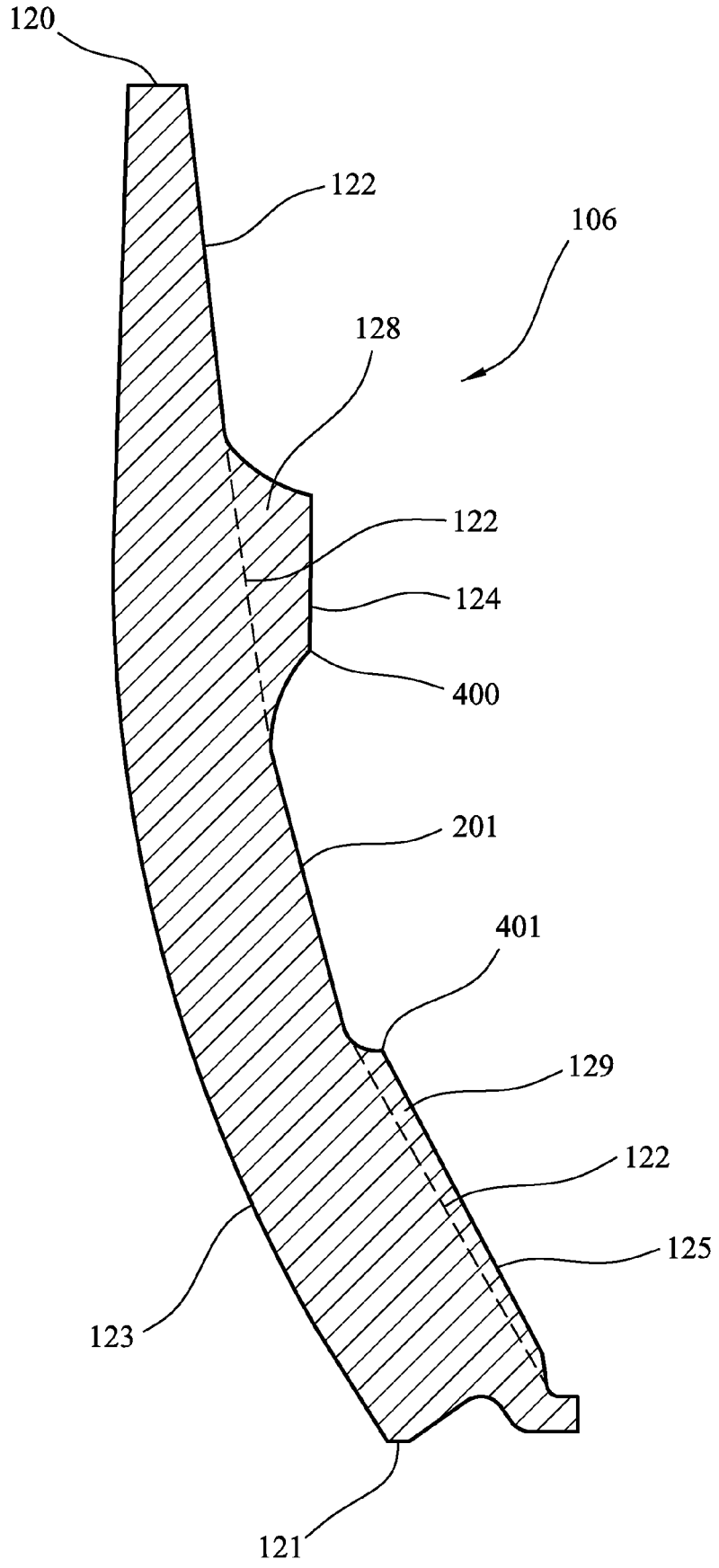
FIG. 5 is a cross sectional elevation view through a crushing shell according to a further specific implementation of the present disclosure where a first upper and a second lower contact surface are aligned transverse to one another.

Referring to FIGS. 2 to 5, the axially uppermost contact region 128 is formed generally as a circumferentially extending shoulder that is raised radially outward from the main body of the shell, and in particular mount surface 122, that extends axially downward from first end 120. Mount surface 122 is defined as the radially outward facing surface extending between upper and lower ends 120, 121. In particular, mount surface 122 corresponds to the radially outward facing surface axially above the contact surfaces 124. The mount surface 122 also corresponds to the trough region of a channel 201 that extends axially below contact surfaces 124. An imaginary extension of the mount surface 122 is illustrated in FIGS. 4 and 5 to extend radially underneath the upper 128 and lower 129 mount regions to show the radially 'raised profiling' of the regions 128, 129 relative to this mount surface 122. That is, mount surface 122 at the region radially inward from contact surfaces 124 is defined as the linear extension, in the axial direction between the radially outward facing surface 122 extending from first end 120 and the trough of channel 201 that extends axially below contact surfaces 124. Accordingly, a radial wall thickness of shell 106 is greatest at the axial positions corresponding to regions 128, 129 relative to the shell wall thickness at a region immediately below end 120 and an axial position corresponding to channel 201.

The raised shoulder region 128 is however discontinuous in the circumferential direction and is formed as spatially separated shoulder sections 204. Each section 204 is spaced apart in a circumferential direction around central longitudinal axis 115 by a plurality of grooves 200 (or recesses) indented within contact region 128 and extending radially inward from contact surface 124. According to the specific implementation, shell 106 comprises six grooves 200 uniformly spaced around axis 115 to define six corresponding shoulder sections 204 also arranged around axis 115. In particular, each of the six contact surfaces 124 extends through an arcuate path (around axis 115) by an angle of 52 degrees. Additionally, an angular length of each groove 200 in the circumferential direction around axis 115 is 8 degrees. Each groove 200 is therefore defined by two opposed radially extending end faces 202 that terminate each end of raised shoulder sections 204. A trough of each groove 200 corresponds approximately to the radial position of mount surface 122 as illustrated in FIG. 4. In a further embodiment, a radial depth of each groove 200 is greater than a radial thickness of the raised region 128 such that a trough of each groove is positioned radially inward of the region illustrated by the dashed line 122.

The raised shoulder sections 204 are separated axially from the lower second contact region 129 by channel 201 that extends circumferentially around axis 115. An axial length of channel 201 is approximately equal to an axial length of each shoulder section 204. Additionally, a trough region of channel 201 corresponds approximately to the radial position of mount surface 122 as illustrated in FIG. 4. That is, channel 201 is defined at its axially uppermost point by circumferential edge 400 (positioned at upper first contact region 128) and at its axially lowermost point by circumferential edge 401 (positioned at lower second contact region 129).

Each shoulder section 204 is accordingly formed as an elongate projection extending part circumferentially around axis 115 and being raised radially outward from channel 201 (positioned immediately below region 128 in the axially direction) and mount surface 122 (positioned axially intermediate between raised region 128 and upper shell end 120).

According to the specific implementation, an axial length of lower contact surface 125 is greater than the axial length of upper contact surface 124. Additionally, an approximate radial depth of each raised region 128, 129 is approximately equal relative to mount surface 122 and the trough of channel 201. As illustrated in FIG. 4, the overall shell wall thickness from first end 120 increases axially to second end 121 notwithstanding a general reduction in the wall thickness at the region of channel 201. According to the specific implementation, the lower contact surface 125 and the upper contact surface 124 comprise a metal or metal alloy, being the same metal or metal alloy of the main body of the crushing shell 106.

The present shape and configuration of the outer shell 106 is advantageous to allow introduction of a backing material suitable to reinforce shell 106 at the region of channel 201 specifically for use in tough and extreme conditions. The filling of channel 201 with backing material effectively adjusts the shell physical dimensions, in particular by increasing the combined radial thickness (shell plus backing material at the channel region 201), and to assist seating against surface regions 126, 127 or an intermediate spacer ring (not shown). The recessed pathway regions 200 are designed allow the flow of backing material introduced from a region of upper end 120 into the channel 201. The grooves 200 are also configured to accommodate backing material to fill the void between shoulder sections 204. Shell 106 is specifically adapted to accommodate the backing material within channel 201 to structurally reinforce shell 106 when worn and/or when employed in high pressure and high power input applications. As the interface 203 between recesses 200 and channel 201 is 'open', backing material may be introduced into recesses 200 and channel 201 via a single filling process. Accordingly, region 129 is devoid of any corresponding grooves and is circumferentially continuous around axis 115 to prevent the backing material passing axially below region 129. The present shell configuration is advantageous to minimise as far as possible the volume of backing material required to reinforce the shell at channel region 201. As will be appreciated, the present concave 106 is also adapted to allow and support the application of backing compound to the region 122 axially above raised region 128 if it is desired to additionally reinforce this section of the concave 122.

FIG. 5 illustrates a further embodiment in which the upper raised region 128 comprises a different shape and configuration to that of the embodiment illustrated in FIG. 4. In particular, the upper contact surfaces 124 are aligned transverse to lower contact surface 125. In particular, surfaces 124 are aligned substantially parallel with axis 115 when shell 106 is mounted in normal use within topshell 111. Accordingly, a wall thickness of shell 106 is greatest at an axially upper section of raised region 128 relative to an axially lower section corresponding to lip 400 that, in part, defines channel 201. The configuration of FIG. 5 is suitable for use with an intermediate spacer ring (not shown) positioned between the axially upper part 128 of shell 106 and the radially inward facing surface 126 of topshell 111. As will be noted however, the axially lower surface 125 sits in direct contact with the topshell surface 127.

Figure 6:
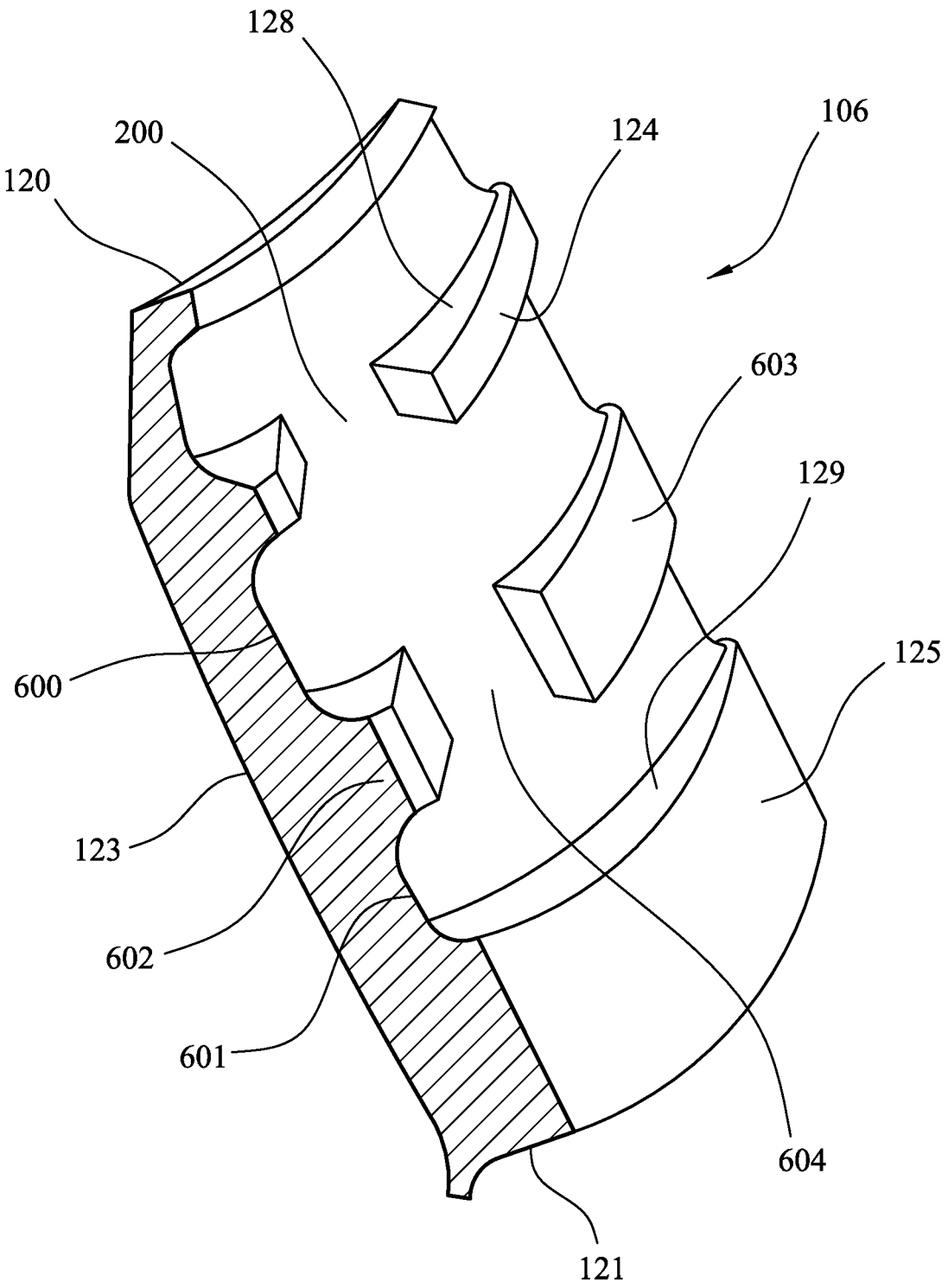
FIG. 6 is a cross sectional perspective view of a crushing shell according to a further specific implementation of the present discliosure having three radially raised contact regions, with the two axially upper regions each comprising respective grooves to receive backing material.

FIG. 6 illustrates a further embodiment in which concave 106 comprises a third raised region 602 positioned axially intermediate the upper first raised region 128 and the second and lower raised region 129. Intermediate raised region 602 also comprises a radially outward facing contact surface 603 extending substantially parallel with upper and lower contact surfaces 124, 125. An axial length of first and intermediate contact surfaces 124, 603 is substantially equal and less than an axial length of the lower contact surface 125. Similar to the upper raised region 128, a plurality of grooves 604 project radially inward within region 602 from radially outermost contact surface 603. FIG. 6 illustrates axially lower grooves 604 corresponding in approximate circumferential position to axially upper grooves 200. However, according to further embodiments, the circumferential position of lower grooves 604 may be different to those of upper grooves 200. A corresponding second channel 601 extends axially between intermediate raised region 602 and lower raised region 129. According to the specific embodiment, an axial length of lower channel 601 is slightly less than an axial length of an upper channel 600 defined axially between the upper raised region 128 and the intermediate raised region 602. Accordingly, backing material may be conveniently introduced into lower channel 601 and upper channel 600 via a single procedure such that the pre-set 'flowable' material may flow in the axially downward direction when introduced at region 120 through upper grooves 200 and lower grooves 604 to completely fill both channels 600 and 601 when cured.

The invention claimed is:

1. A gyratory crusher outer crushing shell comprising:

a main body mountable within a region of a topshell frame of a gyratory crusher, the main body extending around a central longitudinal axis, the main body having a mount surface being outwardly facing relative to the axis for positioning opposed to at least a part of the topshell frame and a crushing surface being inwardly facing relative to the axis to contact material to be crushed;

at least one wall defined by and extending radially between the mount surface and the crushing surface, the wall having a first upper axial end and a second lower axial end;

a raised first contact region positioned axially towards the first upper axial end and extending radially outward relative to the mount surface and in a direction around the axis, the contact region having a radially outward facing raised first contact surface for positioning opposed to a radially inward facing surface of the topshell frame;

a raised second contact region positioned axially towards the second lower axial end and extending radially outward relative to the mount surface in a direction around the axis, the second contact region having a radially outward facing raised second contact surface for positioning opposed to a radially inward facing surface of the topshell frame, the second contact surface extending continuously over the mount surface and around the axis; and a channel extending around the axis and recessed radially inward relative to the first and second raised contact regions to axially separate the first and second raised contact regions, wherein the first contact surface is discontinuous in a direction around the axis via at least one groove extending radially inward within the first raised contact region to provide a pathway through the raised first contact region in the axial direction between a region of mount surface at the first upper axial end and the channel, the at least one groove extending radially by a distance corresponding substantially to at least a full radial depth of the first raised contact region and in a direction axially upward within the first raised contact region from the axially lower channel.

2. The outer crushing shell as claimed in claim 1, wherein the region of the mount surface at the first upper axial end is positioned axially between the first upper axial end and the first raised contact region.

3. The outer crushing shell as claimed in claim 2, wherein the first and second contact surfaces comprise a metal.

4. The outer crushing shell as claimed in claim 2, wherein the first and second contact surfaces are coplanar around the axis.

5. The outer crushing shell as claimed in claim 2, wherein the first and second contact surfaces are aligned transverse to one another relative to the axis.

6. The outer crushing shell as claimed in claim 1, wherein a radial depth of the at least one groove is substantially equal to a radial depth of the first raised contact region defined by a radial distance between the first contact surface and the mount surface.

7. The outer crushing shell as claimed in claim 1, further comprising six grooves defining six contact shoulder sections arranged around the axis.

8. The outer crushing shell as claimed in claim 1, further comprising a plurality of contact shoulder sections extending around the axis defined by a plurality of grooves, each shoulder section extending over an arcuate distance in a range 45° to 55°.

9. The outer crushing shell as claimed in claim 8, wherein each groove extends around the axis and between the contact shoulder sections over an arcuate distance in a range 5 to 15°.

10. The outer crushing shell as claimed in claim 1, further comprising a backing material accommodated at least partially within the channel.

11. The outer crushing shell as claimed claim 1, further comprising a backing material accommodated at least partially within the at least one groove.

12. The outer crushing shell as claimed in claim 1, further comprising:

a third contact region extending radially outward relative to the mount surface in a direction around the axis, the third contact region having a radially outward facing contact surface for positioning opposed to a radially inward facing surface of the topshell frame; and a channel extending around the axis and recessed radially inward relative to the raised third contact region and the raised second contact region to axially separate the second and third contact regions.

13. The outer crushing shell as claimed in claim 12, wherein the third contact surface is discontinuous in a direction around the axis to provide a pathway through the raised third contact region via at least one groove extending radially inward within the third contact region in the axial direction between an axially upper channel and an axially lower channel.

14. A crusher comprising:

a topshell frame; and an outer crushing shell having a main body mountable within a region of the topshell frame, the main body extending around a central longitudinal axis, the main body having a mount surface outwardly facing relative to the axis for positioning opposed to at least a part of the topshell frame and a crushing surface being inwardly facing relative to the axis to contact material to be crushed; at least one wall defined by and extending radially between the mount surface and the crushing surface, the wall having a first upper axial end and a second lower axial end; a raised first contact region positioned axially towards the first upper axial end and extending radially outward relative to the mount surface and in a direction around the axis, the contact region having a radially outward facing raised first contact surface for positioning opposed to a radially inward facing surface of the topshell frame; a raised second contact region positioned axially towards the second lower axial end and extending radially outward relative to the mount surface in a direction around the axis, the second contact region having a radially outward facing raised second contact surface for positioning opposed to a radially inward facing surface of the topshell frame, the second contact surface extending continuously over the mount surface and around the axis; and a channel extending around the axis and recessed radially inward relative to the first and second raised contact regions to axially separate the first and second raised contact regions, wherein the first contact surface is discontinuous in the direction around the axis via at least one groove extending radially inward within the first raised contact region to provide a pathway through the raised first contact region in an axial direction between a region of mount surface at the first upper axial end and the channel, the at least one groove extending radially by a distance corresponding substantially to at least a full radial depth of the first raised contact region and in a direction axially upward within the first raised contact region from the axially lower channel.

* * * * *